US009920780B2

(12) United States Patent
Ueda et al.

(10) Patent No.: US 9,920,780 B2
(45) Date of Patent: Mar. 20, 2018

(54) SLEWING DRIVE APPARATUS FOR CONSTRUCTION MACHINE

(71) Applicant: KOBELCO CONSTRUCTION MACHINERY CO., LTD., Hiroshima-shi (JP)

(72) Inventors: Koji Ueda, Hiroshima (JP); Takaaki Izuka, Hiroshima (JP)

(73) Assignee: KOBELCO CONSTRUCTION MACHINERY CO., LTD., Hiroshima-shi (JP)

( * ) Notice: Subject to any disclaimer, the term of this patent is extended or adjusted under 35 U.S.C. 154(b) by 355 days.

(21) Appl. No.: 14/747,233

(22) Filed: Jun. 23, 2015

(65) Prior Publication Data

US 2016/0032949 A1 Feb. 4, 2016

(30) Foreign Application Priority Data

Jul. 30, 2014 (JP) ..... 2014-154654

(51) Int. Cl.
*F15B 21/08* (2006.01)
*E02F 9/12* (2006.01)
(Continued)

(52) U.S. Cl.
CPC ..... *F15B 21/082* (2013.01); *E02F 9/123* (2013.01); *E02F 9/226* (2013.01); *E02F 9/2228* (2013.01);
(Continued)

(58) Field of Classification Search
CPC ..... F15B 21/082; F15B 11/04; F15B 11/08; E02F 9/2296
See application file for complete search history.

(56) References Cited

U.S. PATENT DOCUMENTS 6,981,371 B2 * 1/2006 Imanishi ..... E02F 9/2225 60/420
8,776,511 B2 * 7/2014 Zhang ..... F15B 21/14 60/410
(Continued)

FOREIGN PATENT DOCUMENTS

CN 1109950 A 10/1995
CN 101863425 A 10/2010
(Continued)

OTHER PUBLICATIONS

Japanese Office Action dated Jun. 14, 2016 in Patent Application No. 2014-154654 (with English Translation).
(Continued)

*Primary Examiner* — Thomas E Lazo
(74) *Attorney, Agent, or Firm* — Oblon, McClelland, Maier & Neustadt, L.L.P.

(57) ABSTRACT

Provided is a slewing drive apparatus for a construction machine capable of satisfactory pump-flow-rate control regardless of change in engine speed, including a variable displacement hydraulic pump, a slewing motor, a slewing operation device, a control valve, a relief valve, and a pump-flow-rate control device that performs a relief cut control and includes: a section for detecting an engine revolution number Ne and a slewing speed of a slewing body; a section for determining a target pump flow rate Qo that is a sum of a slewing-speed correspondence flow rate Q1 and a minimum required relief flow rate Qmin; a section for determining a target pump-tilt-angle qtg obtained by dividing the target pump flow rate Qo by the detected engine revolution number Ne; and a section for adjusting an actual pump-tilt-angle of the hydraulic pump so as to bring the actual pump-tilt-angle to the target pump-tilt-angle qtg.

2 Claims, 3 Drawing Sheets

(51) Int. Cl.

| | |
|---|---|
| ***E02F 9/22*** | (2006.01) |
| ***F15B 11/04*** | (2006.01) |
| ***F15B 11/08*** | (2006.01) |
| ***F15B 13/02*** | (2006.01) |
| ***F15B 13/04*** | (2006.01) |
| ***F15B 13/044*** | (2006.01) |

(52) U.S. Cl.

CPC ..... *E02F 9/2235* (2013.01); *E02F 9/2282* (2013.01); *E02F 9/2285* (2013.01); *E02F 9/2296* (2013.01); *F15B 11/04* (2013.01); *F15B 11/08* (2013.01); *F15B 13/024* (2013.01); *F15B 13/0401* (2013.01); *F15B 13/044* (2013.01); *F15B 2211/20523* (2013.01); *F15B 2211/20546* (2013.01); *F15B 2211/255* (2013.01); *F15B 2211/3116* (2013.01); *F15B 2211/405* (2013.01); *F15B 2211/50518* (2013.01); *F15B 2211/632* (2013.01); *F15B 2211/633* (2013.01); *F15B 2211/6309* (2013.01); *F15B 2211/6316* (2013.01); *F15B 2211/6336* (2013.01); *F15B 2211/6346* (2013.01); *F15B 2211/6652* (2013.01); *F15B 2211/6654* (2013.01); *F15B 2211/7058* (2013.01)

(56) References Cited

U.S. PATENT DOCUMENTS

| | | | | |
|---|---|---|---|---|
| 2004/0231326 | A1* | 11/2004 | Imanishi | E02F 9/2225 60/534 |
| 2005/0204735 | A1 | 9/2005 | Sugano | |
| 2009/0217653 | A1* | 9/2009 | Zhang | E02F 9/2217 60/414 |
| 2014/0166135 | A1* | 6/2014 | Yamashita | E02F 9/123 137/565.16 |

FOREIGN PATENT DOCUMENTS

| | | | |
|---|---|---|---|
| CN | 101981325 | A | 2/2011 |
| JP | 2005-265002 | | 9/2005 |
| JP | 2007-232148 | A | 9/2007 |
| JP | 2011-149473 | A | 8/2011 |
| JP | 2011-208790 | | 10/2011 |

OTHER PUBLICATIONS

Extended European Search Report dated Mar. 14, 2016 in European Patent Application No. 15175190.6.

Combined Office Action and Search Report dated Sep. 1, 2017 in Chinese Patent Application No. 201510386194.8 (with unedited computer generated English Summary translation and English translation of categories of cited documents).

* cited by examiner

SLEWING DRIVE APPARATUS FOR CONSTRUCTION MACHINE

TECHNICAL FIELD

The present invention relates to a slewing drive apparatus to be installed on a construction machine including a slewing body such as a hydraulic excavator to hydraulically slew the slewing body.

BACKGROUND ART

The background art of the present invention will be described by taking a hydraulic excavator shown in FIG. 6 as an example.

The hydraulic excavator includes a crawler type of lower traveling body 1, an upper slewing body 2 mounted on the lower traveling body 1 so as to be slewed around an axis X perpendicular to the ground surface, and a working attachment 3 installed on the upper slewing body 2. The working attachment 3 has a boom 4, an arm 5, a bucket 6, and a plurality of hydraulic cylinders that drive these units, namely, a boom cylinder 7, an arm cylinder 8, and a bucket cylinder 9. The hydraulic excavator further includes a plurality of hydraulic motors which are hydraulic actuators other than the cylinders 7 to 9. The plurality of hydraulic motors include a traveling motor that drives the lower traveling body 1 and a slewing motor that drives the upper slewing body 2.

On the hydraulic excavator, mounted is an actuator circuit for driving each hydraulic actuator. The actuator circuit has a hydraulic pump, and a relief valve for limiting maximum pressure in the actuator circuit. The relief valve has a setting pressure (a relief pressure) defining maximum pressure of each hydraulic actuator. Specifically, the relief valve makes a relief action of returning a surplus component of hydraulic fluid discharged from the hydraulic pump to a tank to prevent the pressure of the hydraulic fluid in each hydraulic actuator from exceeding the relief pressure.

The relief action, however, involves a large pressure loss, namely, a relief loss, thereby degrading energy efficiency. For example, in the slewing circuit for slewing the upper slewing body 2, the pressure of the slewing motor exceeds the relief pressure, particularly at a starting time and an acceleration time of the slewing, to thereby increase a relief flow rate, that is, a flow rate of the hydraulic fluid let to the tank by the relief action, resulting in large relief loss.

Japanese Unexamined Patent Publication No. 2011-208790 discloses a relief cut control for suppressing a relief loss at the slewing starting time and the like. The relief cut control involves detecting a slewing speed, determining a target pump flow rate Qo, and adjusting a tilt angle of the hydraulic pump for obtaining the target pump flow rate Qo. The target pump flow rate Qo is the sum of a flow rate Q1 corresponding to the detected slewing speed (a flow rate of actual flow to the slewing motor; hereinafter, referred to as a "speed-correspondence flow rate"), and a "minimum required relief flow rate" Qmin which is a relief rate required for obtaining a minimum pressure required for starting slewing starting, the minimum pressure being a property value of the relief valve.

This conventional technique, however, takes no account of change in the pump flow rate involved by the change in the engine revolution number, though the engine revolution number varies depending on working and the like. The conventional technique, therefore, generates a risk of permitting the change in the engine revolution number to make the minimum required relief flow rate Qmin too small or too large. Specifically, setting for obtaining the minimum required relief flow rate Qmin with a relatively high idle engine speed involves a risk of shortage in the pump flow rate with the relatively low idle engine speed, which may prevent pressure required for slewing from being generated to thereby make it impossible to start or accelerate slewing. Reversely, setting for obtaining the minimum required relief flow rate Qmin with a relatively low idle engine speed generates a risk of making the pump flow rate too large with the relatively high idle engine speed, which prevents energy saving as an original object of the relief cut from being achieved.

SUMMARY OF INVENTION

An object of the present invention is to provide a slewing drive apparatus for a construction machine, the apparatus being capable of satisfactory pump-flow-rate control regardless of change in engine speed. Provided is a slewing drive apparatus installed on a construction machine including a slewing body to slew the slewing body. The slewing drive apparatus includes: an engine; a variable displacement hydraulic pump that is driven by the engine to thereby discharge a hydraulic fluid; a slewing motor that slews the slewing body; a slewing operation device that receives an operation for actuating the slewing motor and outputs a slewing command corresponding to the operation; a control valve that makes a valve opening action so as to control the actuation of the slewing motor, in response to the slewing command output by the slewing operation device; a relief valve that defines a maximum pressure of the slewing motor; and a pump-flow-rate control device that controls a pump-tilt-angle determining a pump flow rate that is a discharge flow rate of the hydraulic pump. The pump-flow-rate control device performs a relief cut control, and includes: a section for detecting an engine revolution number Ne and a slewing speed of a slewing body; a section for determining a target pump flow rate Qo that is a sum of a slewing-speed correspondence flow rate Q1 that is a flow rate of a hydraulic fluid actually flowing to the slewing motor, the flow rate corresponding to the detected slewing speed, and a minimum required relief flow rate Qmin that is a flow rate of a hydraulic fluid flowing in the relief valve and is a minimum flow rate for securing a pressure required for starting slewing of the slewing body; a section for determining a target pump-tilt-angle qtg that is a value obtained by dividing the target pump flow rate Qo by the detected engine revolution number Ne; and a section for adjusting an actual pump-tilt-angle of the hydraulic pump so as to bring the actual pump-tilt-angle to the target pump-tilt-angle qtg.

DESCRIPTION OF EMBODIMENTS

Figure 6:
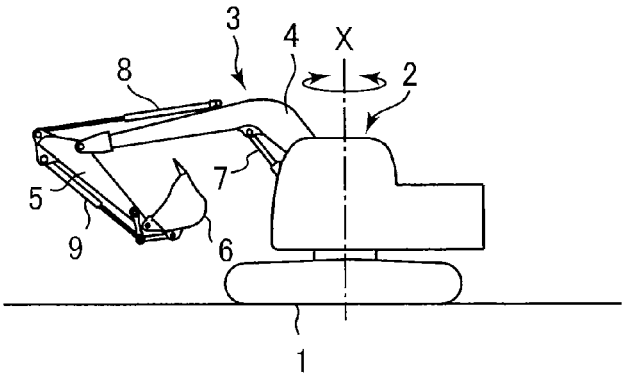
FIG. 6 is a schematic side view of a hydraulic excavator as an example of an item to which the present invention is applied.

There will be described an embodiment of the present invention with reference to the drawings. In the present embodiment, a stewing drive apparatus shown in FIG. 1 is applied to a hydraulic excavator shown in FIG. 6.

Figure 1:
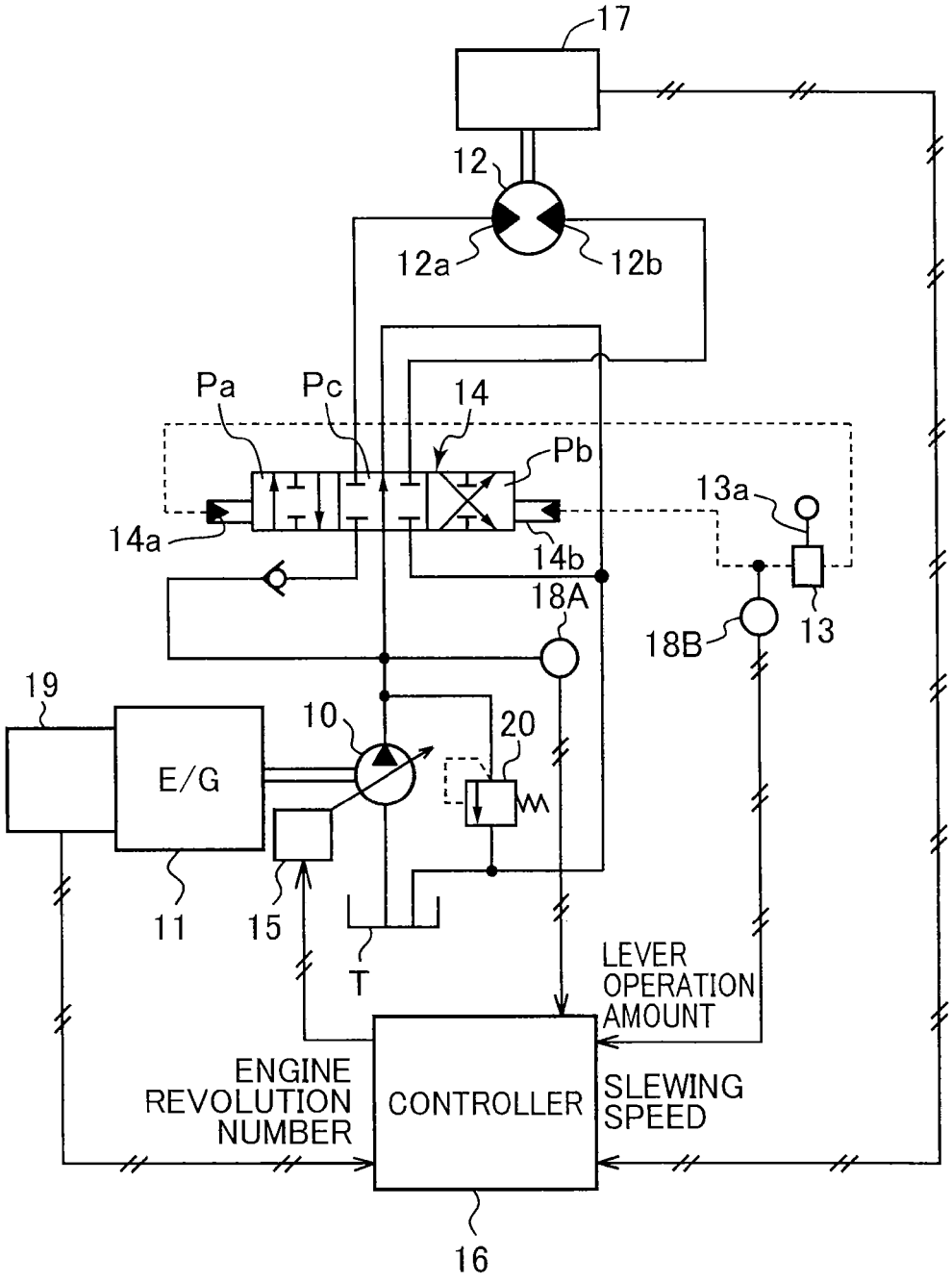
FIG. 1 is a circuit diagram showing a slewing drive apparatus for a construction machine according to an embodiment of the present invention.

FIG. 1 shows a circuit constituting the stewing drive apparatus. The stewing drive apparatus includes: an engine 11; a hydraulic pump 10 that is driven by the engine 11 to thereby discharge a hydraulic fluid; a stewing motor 12 having a pair of ports 12*a* and 12*b* and configured to be rotated by the hydraulic fluid discharged from the hydraulic pump 10 and supplied to any one of the pair of ports 12*a* and 12*b* to thereby slew the upper stewing body 2 shown in FIG. 6; a remote control valve 13, which is a stewing operation device; a plurality of detectors; a control valve 14 disposed between the stewing motor 12 and a pair of the hydraulic pump 10 and a tank T, and a relief valve 20 that defines a maximum pressure of the stewing motor 12.

The remote control valve 13 includes an operation lever 13*a* configured to receive an operation for actuating the stewing motor 12, and outputs a pilot pressure serving as a stewing command that corresponds to the operation applied to the lever 13*a*.

The control valve 14 according to the present embodiment is formed of a hydraulic pilot switching valve. Specifically, the control valve 14 has a pair of pilot ports 14*a* and 14*b* which receives input of the pilot pressure output by the remote control valve 13, and is opened by the pilot pressure input to any one of the pair of pilot ports 14*a* and 14*b*, thereby making a control of a supply and discharge of the hydraulic fluid with respect to the slewing motor 12, that is, respective controls of switching between slewing and stopping of the slewing motor 12, a rotation direction, and a rotation speed.

The control valve 14 has a neutral position Pc, a leftward slewing position Pa, and a rightward slewing position Pb. The control valve 14 is retained at the neutral position Pc when no pilot pressure is supplied to each of the pilot ports 14*a* and 14*b* to block, at the neutral position Pc, blocks the communication between the hydraulic pump 10 and the hydraulic motor 12. Upon supply of a pilot pressure to the pilot port 14*a*, the control valve 14 is shifted from the neutral position Pc to the leftward slewing position Pa at a stroke corresponding to the magnitude of the pilot pressure, thereby forming, at the leftward slewing position Pa, a fluid path for supplying the hydraulic fluid discharged from the hydraulic pump 10 to the port 12*a* of the hydraulic motor 12 and letting the hydraulic fluid discharged from the port 12*b* of the hydraulic motor 12 to the tank T. Upon supply of a pilot pressure to the pilot port 14*b*, the control valve 14 is shifted from the neutral position Pc to the rightward slewing position Pb at a stroke corresponding to the magnitude of the pilot pressure, thereby forming, at the rightward slewing position Pb, a fluid path for supplying the hydraulic fluid discharged from the hydraulic pump 10 to the port 12*b* of the hydraulic motor 12 and letting the hydraulic fluid discharged from the port 12*a* of the hydraulic motor 12 to the tank T.

When no operation is applied to the operation lever 13*a*, the remote control valve 13 outputs no pilot pressure. Upon an operation applied to the operation lever 13*a* in a direction for the leftward slewing, the remote control valve 13 inputs a pilot pressure having a magnitude corresponding to the amount of the operation to the pilot port 14*a* of the control valve 14. Upon an operation applied to the operation lever 13*a* in a direction for the rightward slewing, the remote control valve 13 inputs a pilot pressure of a magnitude corresponding to the amount of the operation to the pilot port 14*b* of the control valve 14.

The slewing motor 12 is, thus, rotated in a slewing direction corresponding to the direction of the operation applied to the operation lever 13*a* of the remote control valve 13, at a speed corresponding to the amount of the operation (hereinafter, referred to as a "lever operation amount"), thereby slewing the upper slewing body 2.

The hydraulic pump 10 is a variable displacement hydraulic pump, the pump flow rate as a discharge flow rate of the hydraulic pump being variable. The slewing drive apparatus further includes a pump-flow-rate control device that controls the pump flow rate. The pump-flow-rate control device includes a pump regulator 15, a controller 16, and sensors 17, 18A, 18B, and 19.

The pump regulator 15 changes the tilt angle of the hydraulic pump 10 in accordance with a tilt-angle command input by the controller 16.

The plurality of detectors include: a slewing speed sensor 17 that detects a rotation speed of the slewing motor 12 corresponding to the slewing speed of the upper slewing body 2; a pair of pressure sensors 18A and 18B that detect respective pilot pressures input by the remote control valve 13 to the pair of pilot ports 14*a* and 14*b*, the pilot pressure allowing the lever operation amount to be specified; and engine speed sensor 19 that detects an engine revolution number Ne of the engine 11.

The sensors 17, 18A, 18B, and 19 generate detection signals of their respective detected items, and input them to the controller 16. The controller 16 generates the tilt-angle command signal, based on the input detection signals, and inputs the tilt-angle command signal to the pump regulator 15.

Figure 2:
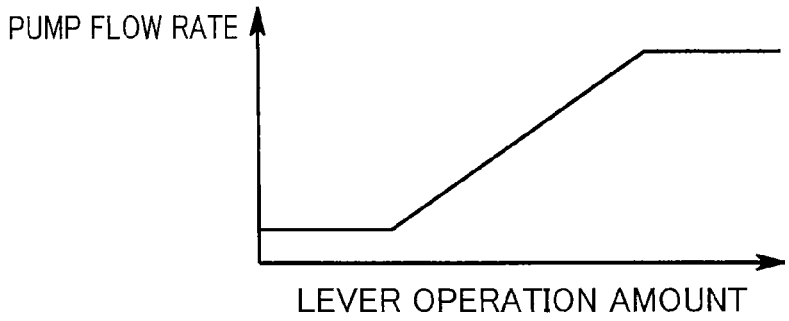
FIG. 2 is a diagram showing a relationship between a lever operation amount and a pump flow rate under a positive control according to the embodiment.
Figure 3:
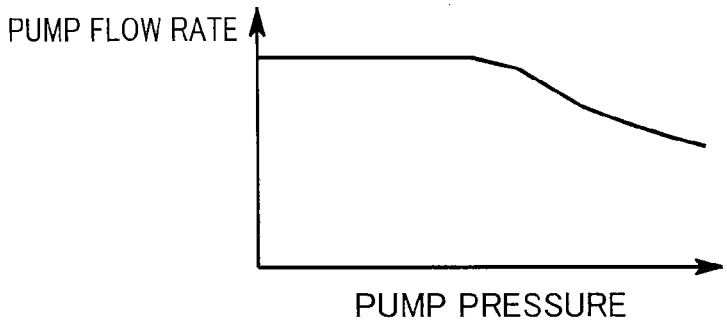
FIG. 3 is a diagram showing a relationship between a pump pressure and a pump flow rate under a PQ control according to the embodiment.
Figure 4:
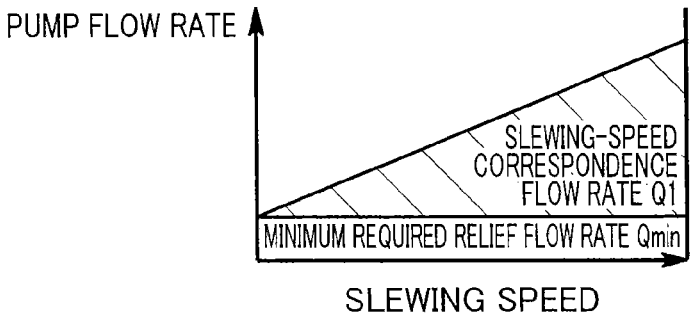
FIG. 4 is a diagram showing a relationship between a slewing speed and a pump flow rate under a relief cut control according to the embodiment.

The controller 16 according to the present embodiment includes: a section for determining a plurality of target pump flow rates, based on respective different kinds of controls; and a section for selecting a minimum target pump flow rate out of the plurality of target pump flow rates, as a final target pump flow rate. The plurality of kinds of controls include: (I) a positive control of increasing a pump flow rate in accordance with an increase in the lever operation amount, as shown in FIG. 2; (II) a PQ control (a horse power control or a pressure feedback control) of reducing a pump flow rate in accordance with an increase in the pump pressure that is a discharge pressure of the hydraulic pump 10, as shown in FIG. 3; and (III) a relief cut control for reducing a relief loss, as shown in FIG. 4.

To make the relief cut control, the pump-flow-rate control device includes the following sections:

(a) a section for detecting the engine revolution number Ne of the engine 11 and a slewing speed of the upper slewing body 2;

(b) a section for determining a target pump flow rate Qo, the target pump flow rate Qo being a sum of a slewing-speed correspondence flow rate Q1 that is a flow rate of the hydraulic fluid actually flowing to the slewing motor 12 (a section with shaded lines in FIG. 4), the flow rate corresponding to the detected slewing speed, and a minimum required relief flow rate Qmin that is a flow rate of a hydraulic fluid flowing in the relief valve 20 and is a minimum flow rate required for securing a pressure required for starting slewing of the upper slewing body 2;

(c) a section for determining a target pump-tilt-angle qtg, which is a value obtained by dividing the target pump flow rate Qo by the detected engine revolution number Ne; and (d) a section for adjusting an actual tilt angle of the hydraulic pump 10 so as to bring the actual tilt angle to the target pump-tilt-angle qtg.

Figure 5:
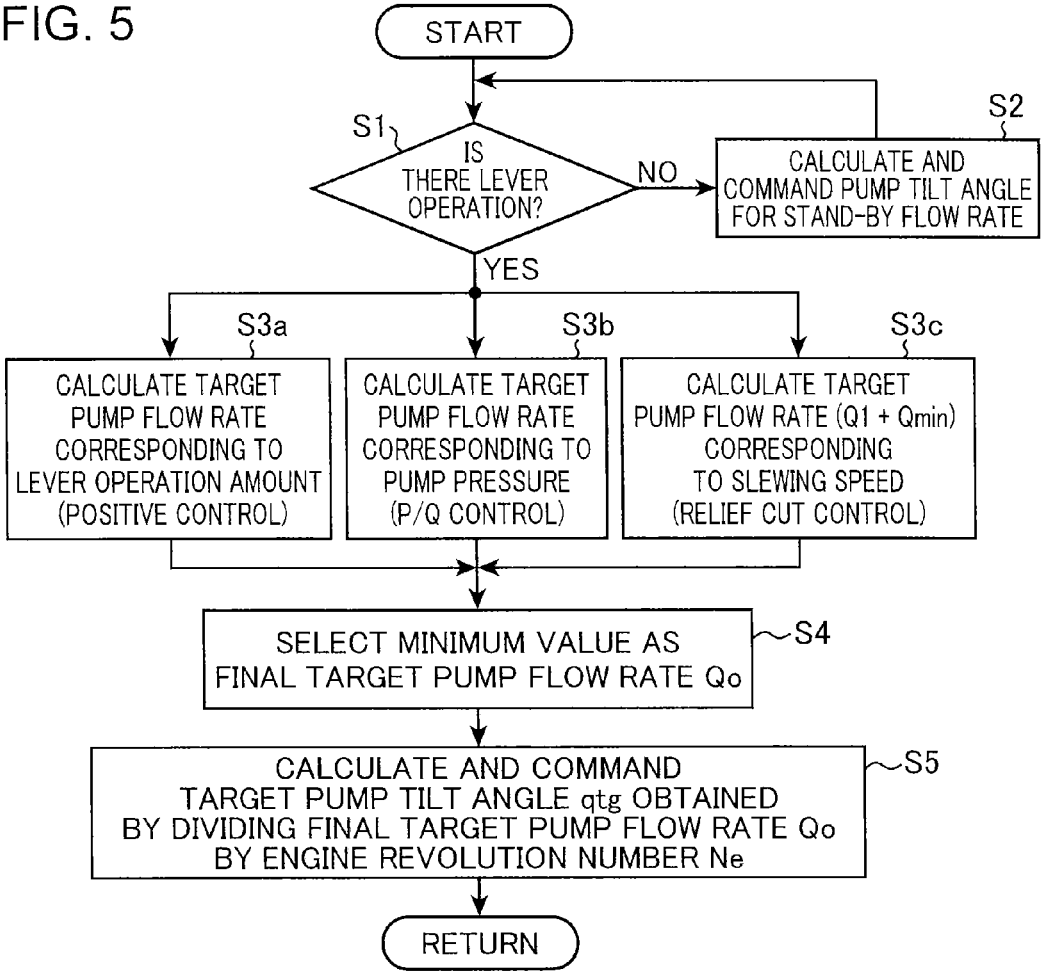
FIG. 5 is a flowchart showing a control operation made by a pump-flow-rate control device according to the embodiment.

Next will be described below in detail the control operations made by the controller 16, including the relief cut control by a flowchart in FIG. 5.

The controller 16 judges in Step S1 whether there exists or not a lever operation, that is, an operation applied to the remote control valve 13. In the case of no lever operation (NO in Step S1), the controller 16 calculates in Step S2 a pump-tilt-angle for making the pump flow rate be a preset standby-flow-rate, generates a tilt-angle command signal corresponding to the calculated pump-tilt-angle, inputs the generated tilt-angle command signal to the pump regulator 15, and thereafter repeats the processing in Step 1.

When judging in Step S1 that there exists a lever operation (YES in Step S1), the controller 16 sequentially executes Steps S3*a*, S3*b*, and S3*c* to thereby calculate a plurality of target pump flow rates based on the respective kinds of controls. Specifically, the controller 16 performs: calculating, in Step S3*a*, a target pump flow rate based on the positive control shown in FIG. 2, that is, a target pump flow rate corresponding to the lever operation amount; calculating, in Step S3*b*, a target pump flow rate based on the PQ control shown in FIG. 3, that is, a pump flow rate corresponding to the pump pressure; and calculating, in Step S3*c*, a target pump flow rate based on the relief cut control in FIG. 4, that is, a target pump flow rate equal to the sum of the slewing-speed correspondence flow rate Q1 and the minimum required relief flow rate Qmin.

Furthermore, in Step S4, the controller 16 selects a minimum target pump flow rate out of the target pump flow rates based on the respective controls, as the final target pump flow rate Qo. At the starting time and the acceleration time of the slewing of the upper slewing body 2, the target pump flow rate based on the relief cut control becomes minimum because the slewing-speed correspondence flow rate Q1 relating to the relief cut control is small, thus being selected as the final target pump flow rate Qo.

The controller 16 obtains the target pump-tilt-angle qtg by dividing the thus selected final target pump flow rate Qo by the engine revolution number Ne, generates the tilt-angle command signal corresponding to the target pump-tilt-angle qtg, and inputs the tilt-angle command signal to the pump regulator 15. Thereafter, the controller 16 repeats the operation after Step S1.

In the case where the target pump flow rate based on the relief cut control is selected as the final target pump flow rate Qo, obtaining the target pump-tilt-angle qtg by dividing the target pump flow rate Qo by the engine revolution number Ne and adjusting the actual pump-tilt-angle so as to bring actual pump-tilt-angle to the target pump-tilt-angle qtg enables a preferable pump-flow-rate control taking account of the change in the engine revolution number Ne to be performed. This allows a proper relieve cut control which prevents the minimum required relief flow rate Qmin from being too small or too large depending on the change of the engine revolution number Ne to be always performed.

Furthermore, the controller 16 according to the present embodiment, including a section for determining target pump flow rates based on respective different kinds of controls (namely, the relief cut control, the positive control, and the PQ control) and a section for selecting a minimum target pump flow rate out of the target pump flow rates, as the final target pump flow rate Qo, to determine the target pump-tilt-angle qtg by dividing the target pump flow rate Qo by the engine revolution number Ne, can reduce the relief loss by selecting the target pump flow rate based on the positive control at a steady slewing time after the finish of the starting or acceleration of the slewing. Thus achieved is a preferable pump-tilt-angle control capable of taking advantages of respective characteristics of the plurality of controls in accordance with a specific mode of the actual slewing.

The present invention is not limited to the above embodiment. The present invention includes, for example, the following modes.

The control except for the relief cut control is not limited to the positive control or the PQ control but permitted to be, for example, a negative control or a load sensing control. Furthermore, the pump-flow-rate control device according to the present invention may include only the section for calculating a target pump flow rate based on the relief cut control while including no sections for determining the plurality of target pump flow rates based on the respective kinds of controls.

In the present invention, detailed procedures until generating the tilt-angle command signal are not limited to ones described above. While the above embodiment includes sequential performance of calculating the plurality of target pump flow rates based on respective kinds of controls, selecting the minimum pump target flow rate out of the plurality of target pump flow rates as the final target pump flow rate Qo, and calculating the target pump-tilt-angle qtg by dividing the final target pump flow rate Q by the engine revolution number Ne, the present invention also includes sequential performance of calculating a plurality of target pump-tilt-angles by dividing target pump flow rates corresponding to the respective kinds of controls by the engine revolution number Ne, respectively, and selecting a minimum target pump-tilt-angle out of a calculated plurality of target pump-tilt-angles as the final target pump-tilt-angle qtg.

The present invention can be broadly applied to construction machines each of which includes a slewing body capable of being slewed by a hydraulic motor as a driving source, not limited to the hydraulic excavator.

As described above, according to the present invention is provided a slewing drive apparatus for a construction machine, the apparatus being capable of satisfactory pump-flow-rate control regardless of change in engine speed. Provided is a slewing drive apparatus installed on a construction machine including a slewing body to slew the slewing body. The slewing drive apparatus includes: an engine; a variable displacement hydraulic pump that is driven by the engine to thereby discharge a hydraulic fluid; a slewing motor that slews the slewing body; a slewing operation device that receives an operation for actuating the slewing motor and outputs a slewing command corresponding to the operation; a control valve that makes a valve opening action so as to control the actuation of the slewing motor, in response to the slewing command output by the slewing operation device; a relief valve that defines a maximum pressure of the slewing motor; and a pump-flow-rate control device that controls a pump-tilt-angle determining a pump flow rate that is a discharge flow rate of the hydraulic pump. The pump-flow-rate control device performs a relief cut control, including: a section for detecting an engine revolution number Ne and a slewing speed of a slewing body; a section for determining a target pump flow rate Qo that is a sum of a slewing-speed correspondence flow rate Q1 that is a flow rate of a hydraulic fluid actually flowing to the slewing motor, the flow rate corresponding to the detected slewing speed, and a minimum required relief flow rate Qmin that is a flow rate of a hydraulic fluid flowing in the relief valve and is a minimum flow rate for securing a pressure required for starting slewing of the slewing body; a section for determining a target pump-tilt-angle qtg that is a value obtained by dividing the target pump flow rate Qo by the detected engine revolution number Ne; and a section for adjusting an actual pump-tilt-angle of the hydraulic pump so as to bring the actual pump-tilt-angle to the target pump-tilt-angle qtg.

Obtaining the target pump-tilt-angle qtg by dividing the target pump flow rate Qo, which is a sum of the slewing-speed correspondence flow rate Q1 and the minimum required relief flow rate Qmin, by the engine revolution number Ne, and adjusting the actual pump-tilt-angle so as to bring the actual pump-tilt-angle to the target pump-tilt-angle qtg enables a preferable pump-flow-rate control taking account of the change in the engine revolution number Ne to be performed, that is, enables the proper minimum required relief flow rate Qmin to be secured, regardless of the change in the engine revolution number Ne.

The pump-flow-rate control device, preferably, includes: a section for determining a plurality of target pump flow rates based on respective different kinds of controls including the relief cut control (for example, a relief cut control, a positive control and a PQ control); and a section for selecting a minimum target pump flow rate out of the plurality of target pump flow rates, as a final target pump flow rate, and obtains the target pump-tilt-angle qtg by dividing the selected target pump flow rate by the engine revolution number Ne. The pump-flow-rate control device can make a preferable pump-tilt-angle control capable of taking advantage of respective characteristics of the plurality of controls in accordance with a detailed mode of the actual slewing. For example, the pump-flow-rate control device can make the relief loss be more small, by selecting the target pump flow rate based on the positive control at a steady slewing time after the finish of the starting or acceleration of the slewing.

This application is based on Japanese Patent application No. 2014-154654 filed in Japan Patent Office on Jul. 30, 2014, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

The invention claimed is:

1. A slewing drive apparatus to be installed on a construction machine including a slewing body to slew the slewing body, the slewing drive apparatus comprising:

an engine;

a variable displacement hydraulic pump that is driven by the engine to thereby discharge a hydraulic fluid;

a slewing motor that slews the slewing body;

a slewing operation device that receives an operation for actuating the slewing motor and outputs a slewing command corresponding to the operation;

a control valve that makes a valve opening action so as to control the actuation of the slewing motor, in response to the slewing command output by the slewing operation device;

a relief valve that defines a maximum pressure of the slewing motor; and a pump-flow-rate control device that controls a pump-tilt-angle determining a pump flow rate that is a discharge flow rate of the hydraulic pump, characterized in that the pump-flow-rate control device performing a relief cut control and including: a section for detecting an engine revolution number Ne and a slewing speed of a slewing body; a section for determining a target pump flow rate Qo that is a sum of a slewing-speed correspondence flow rate Q1 that is a flow rate of a hydraulic fluid actually flowing to the slewing motor, the flow rate corresponding to the detected slewing speed, and a minimum required relief flow rate Qmin that is a flow rate of a hydraulic fluid flowing in the relief valve and is a minimum flow rate for securing a pressure required for starting slewing of the slewing body; a section for determining a target pump-tilt-angle qtg that is a value obtained by dividing the target pump flow rate Qo by the detected engine revolution number Ne; and a section for adjusting an actual pump-tilt-angle of the hydraulic pump so as to bring the actual pump-tilt-angle to the target pump-tilt-angle qtg, wherein the pump-flow-rate control device further includes: a section for determining a plurality of target pump flow rates based on respective different kinds of controls including the relief cut control; and a section for selecting a minimum target pump flow rate out of the plurality of target pump flow rates, as a final target pump flow rate, the pump-flow-rate control device obtaining the target pump-tilt-angle qtg by dividing the selected target pump flow rate by the engine revolution number Ne.

2. The slewing drive apparatus for a construction machine according to claim 1, wherein the plurality of kinds of controls include: the relief cut control; a positive control using a target pump flow rate corresponding to an amount of operation applied to the slewing operation device; and a PQ control using a target pump flow rate corresponding to a pump pressure that is a discharge pressure of the hydraulic pump.

* * * * *